United States Patent [19]

Lapointe

[11] Patent Number: 4,508,348

[45] Date of Patent: Apr. 2, 1985

[54] ANIMATED PUZZLE BLOCK GAME

[76] Inventor: Wildy Lapointe, 398 Bellevue St., Roberval, Canada, G8H 2R8

[21] Appl. No.: 587,688

[22] Filed: Mar. 8, 1984

[51] Int. Cl.[3] ..... A63F 9/08

[52] U.S. Cl. ..... 273/157 R; 446/103

[58] Field of Search ..... 273/157 R; 446/103

[56] References Cited

U.S. PATENT DOCUMENTS

| | | | |
|---|---|---|---|
| 2,585,419 | 2/1952 | Zarlengo | 273/157 R |
| 3,417,996 | 12/1968 | Zaniszewski | 273/157 R |
| 3,881,274 | 5/1975 | Kanda | 446/103 |

FOREIGN PATENT DOCUMENTS 200548 6/1920 Canada .

*Primary Examiner*—Anton O. Oechsle

[57] ABSTRACT

The block game of the invention comprises an open-top box, including side walls and at least one floor. A plurality of similar regular blocks, designed to be removably contained by the box, are provided, wherein at least one of the blocks includes a movable part embedded therewithin. The movable part includes a top face, occupying a restricted portion of one of the faces of at least one of the blocks, to constitute an animatable portion. A manually-operated handle is carried by the box for driving the movable part within the associated block. At least two of the faces of each block are each adapted to carry a different graphical representation, each forming part of a different large image, wherein the animatable portion appears animated when the handle is activated.

8 Claims, 10 Drawing Figures

ANIMATED PUZZLE BLOCK GAME

FIELD OF THE INVENTION

This invention relates to puzzle block games and, more specifically, to a puzzle block game including one or more animated portions.

BACKGROUND OF THE INVENTION

Animated jig-saw puzzle games are well known in the art. For example, U.S. Pat. No. 3,417,996 of Dec. 24, 1968 to Janiszewski, includes a jig-saw puzzle having gear-like rotatable members 16 connected to certain of the jig-saw pieces of the picture 20 to impart rotary movement thereto. In this patent, it is impossible to form more than one picture.

In U.S. Pat. No. 2,585,419 dated Feb. 12, 1952 granted to Zarlengo, the jig-saw puzzle of FIG. 4, for example, is constituted of a number of puzzle pieces 19 to 26, interconnected by link members 27 and 28 through the engagement of rounded tabs 29 to 34 into circular notches 16, 17, 18, 32, 35, 36. Here again, it is impossible to form more than one picture, since the pieces are of the jig-saw type.

OBJECTS OF THE INVENTION

Accordingly, an essential object of the invention is to provide an animated puzzle block game, wherein the movable parts are embedded within the blocks themselves, and the latter are capable of being assembled in different manners.

Another object of the invention is to provide a puzzle block game which prompts children to play with the same, because some parts can be animated.

It is another object of the invention, according to the above type, to provide a block game of simple construction and durable nature.

It is still another object of the invention, according to the above type, to provide a puzzle block game with driving means to drive the movable parts within the puzzle pieces in order to simulate animation.

Other objects, advantages and capabilities of the present invention will become more apparent as the description proceeds, taken in conjunction with the following drawings.

SUMMARY OF THE INVENTION

In accordance with the objects stated above, the animated puzzle block game comprises an open-top box containing a plurality of similar, regular blocks. The box includes side walls and at least one floor. At least one of the blocks per image includes a movable part embedded therewithin.

The rotatable part includes a top face, occupying a restricted portion of one of the faces of at least one of the blocks per image to constitute an animatable portion. Manual driving means are carried by the box for driving the movable part within the associated block. A disconnectable coupling between the animated portion and the driving means allows removal of the blocks from the box.

At least two of the faces of each block are each adapted to carry a different graphical representation, each forming part of a different large image, wherein the animatable portion appears animated when the driving means is activated.

DETAILED DESCRIPTION OF THE DRAWINGS

Figure 1:
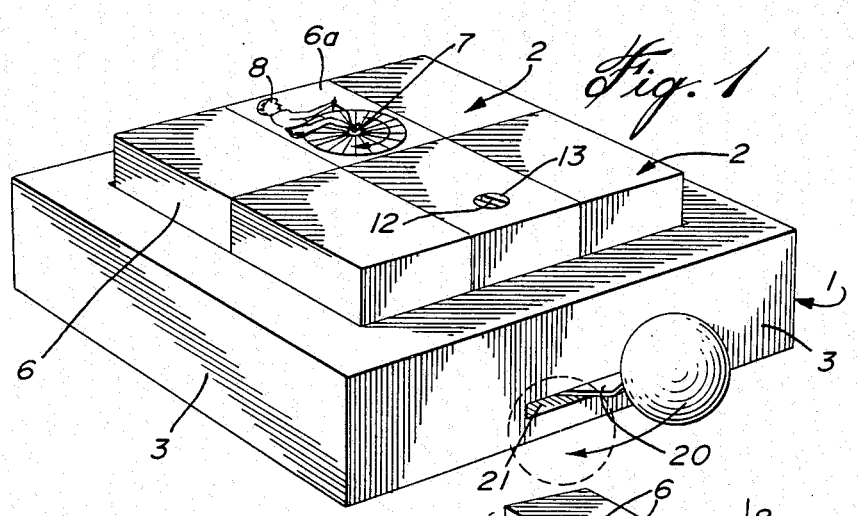
FIG. 1 is a perspective view of a first embodiment of the animated block game.
Figure 2:
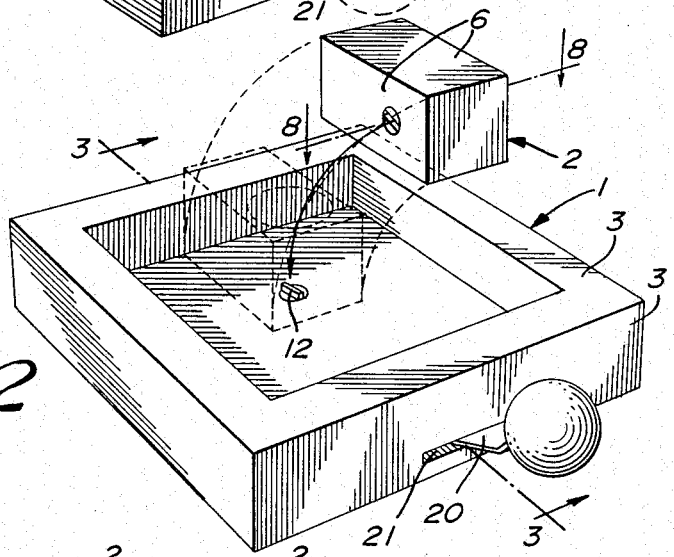
FIG. 2 is a perspective view of the game box of FIG. 1 with the blocks removed, also showing one embodiment of the latter.
Figure 3:
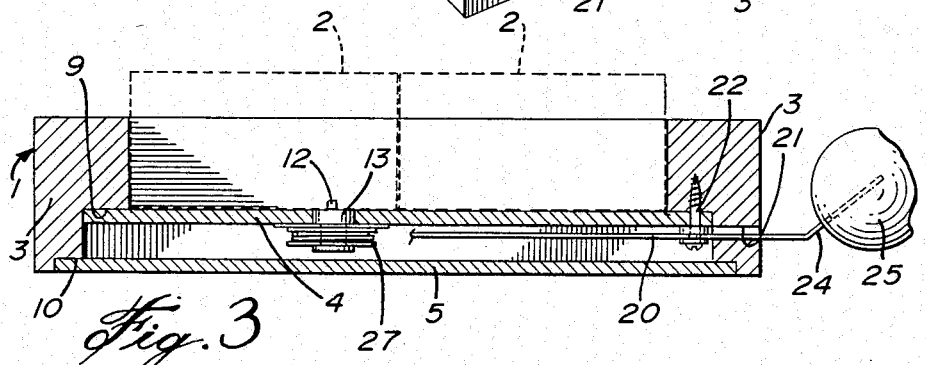
FIG. 3 is a longitudinal sectional view taken along line 3—3 of FIG. 2.

Referring to FIGS. 1 to 4 and 7 and 8, a first embodiment of the invention is shown. The embodiment consists of an open-top box 1 containing a plurality of similar, regular blocks 2, of rectangular shape. The number of blocks is six in this embodiment, but this number can vary.

The box includes side walls 3 and two spaced-apart floors, a false intermediate floor 4 and a bottom floor 5. The false floor 4 is designed to support the blocks 2.

Because each of the blocks 2 has a square end face, four similar longitudinal faces 6 are defined. Thus, a portion of an image may be imprinted on at least two, and up to four faces 6 of each of blocks 2. When the latter are assembled in several predetermined manners, at least two, and up to four different large complete images are obtained.

Furthermore, one of the four faces 6 of at least one and up to six of the blocks 2, i.e. face 6*a*, includes an animated portion 7. Hence, the block game of the invention provides an image which has one portion that can be animated for the better amusement of the user. Up to four different images can be obtained. provided all the blocks 2 are inverted each time accordingly, and up to four corresponding animated portions can be obtained, on different blocks.

For example, it is envisioned that an image 8 represents a cyclist on the face of block 2 with a cycle wheel imprinted on animated portion 7, the remaining blocks carrying portion of an image forming a background for the cyclist.

The lower portion of walls 3 is stepped outwardly at 9 and 10 to allow engagement therethrough of floors 4 and 5, respectively, fixed to the side walls 3. Animated portion 7 forms a shaft (see FIGS. 7 and 8) rotatably mounted within block 2, wherein its two ends are exposed and flush with the associated faces of block 2. The bottom end of the shaft has a diametrical coupling groove 11. The latter is specifically designed for removable coupling connection with the floor protruding key 12 of a rotatable driving spindle 13 (see FIGS. 2 and 3).

Groove 11 and key 12 may be replaced by permanent magnets of opposite polarities for magnetic coupling of the rotating animated portion or shaft 7 to the driving spindle 13.

Figure 7:
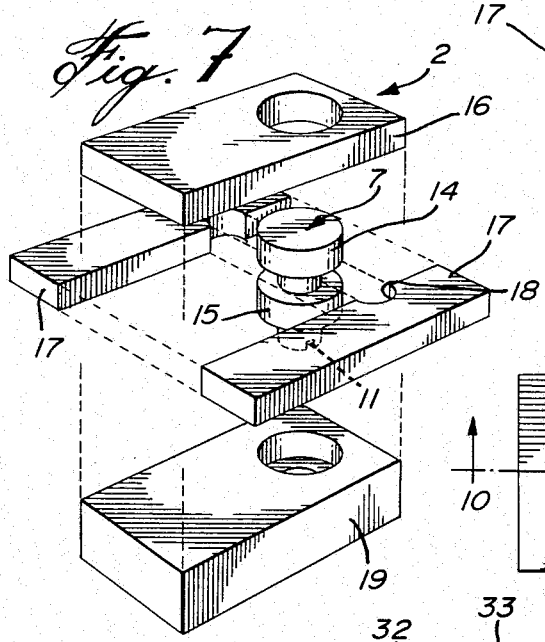
FIG. 7 is an exploded view of one embodiment of a block of the game.
Figure 8:
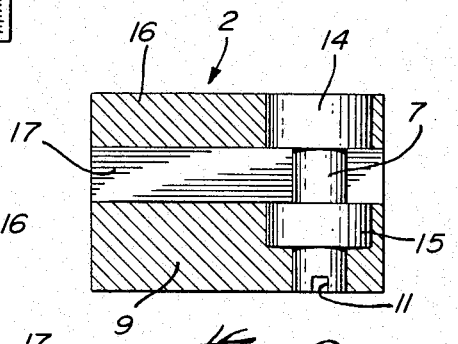
FIG. 8 is a section of the block of FIGS. 2 and 7 and taken along line 8—8 of FIG. 2.

FIGS. 7 and 8 show the construction of block 2 with its animated portion or shaft 7.

The rotatable shaft 7, embedded within block 2, has spaced top and intermediate cylindrical flanges 14 and 15; the outer surface of top flange 14 forms the animated portion. Shaft 7 rotates within a complementary bore formed by separate block portions, namely: top block portion 16, two intermediate block portions 17, each having a recess 18 for receiving the shaft 7 intermediate its flanges 14, 15, and a bottom block portion 19.

Flange 15 prevents axial movement of shaft 7 within block 2, while top flange 14 provides a sufficiently large top face for the animated image-carrying portion.

The construction of the block 2 and its assembly with shaft 7 is facilitated by making block 2 from separate parts 16, 17, and 19 glued together after shaft insertion.

Rotating means are provided to rotate key 12 engaging the groove 11 of anyone of the six blocks 2 for rotating the shaft 7. The rotating means include, apart from spindle 13 which is journalled in bottom floor 5 and false floor 4, a plate-like operating lever 20, extending in-between floors 4 and 5 and outwardly of box 1 through a slot 21 in one side wall 3, and movable in a back-and-forth fashion by pivoting intermediate its ends about a pivot screw 22 which also secures false floor 4 to side wall 3.

Figure 4:
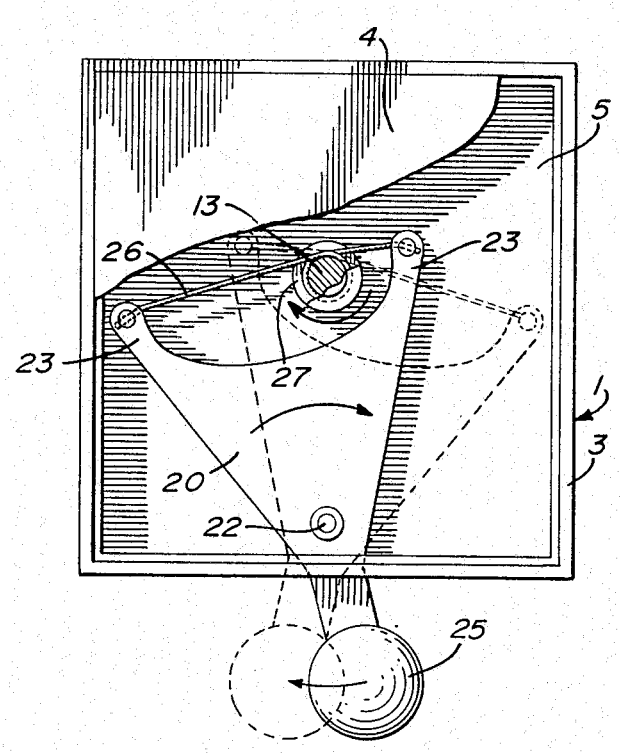
FIG. 4 is a bottom plan view of the box with its main floor partially cut away and showing the inner rotating mechanism of the game of FIG. 1.

As shown in FIG. 4, lever 20 is generally triangularly shaped, extending parallel to the floor and having an inner recessed base end portion forming two spaced legs 23 straddling spindle 13, and an upwardly-extending operating outer end 24, to which is secured a spherical knob 25 for comfortable manual usage. A string 26 is attached to legs 23 and is wound on a pulley 27 fixed to spindle 13.

It can now be readily understood that the lateral back and forth movement of lever 20 by knob 25 causes string 26 to wind on one side and unwind on the other wide of spindle pulley 27 and vice versa, producing reciprocating rotation of spindle 13 and consequently of animated portion 7.

Figure 5:
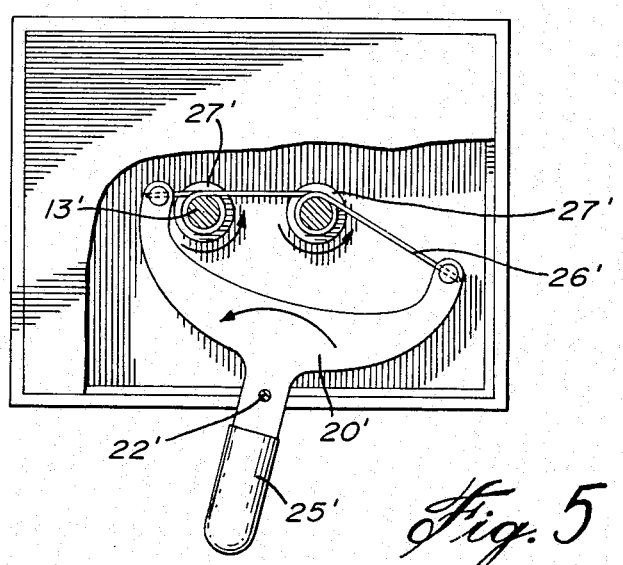
FIG. 5 is a view similar to FIG. 4 but showing a second embodiment.
Figure 6:
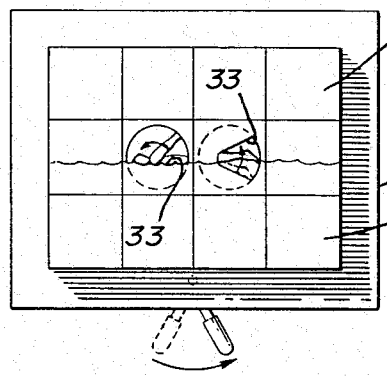
FIG. 6 is a top plan view of the animated block game in accordance with FIG. 5.

The second embodiment of the invention, shown in FIGS. 5, 6, 9 and 10 includes a box 1' containing twelve cubic blocks 2' and two spindles 13', instead of only one. Again, the number of blocks 2' or spindles may vary. The two spindles 13' therefore allow the simultaneous activation of two rotatable shafts 7' of two different blocks 2', the latter being preferably adjacent. As shown in FIG. 5, lever 20' is pivoted to box 1' by screw 22' and has an operating knob or handle 25' and a string 26' as in the first embodiment; however, string 26' is wound around the pulley 27' of each of the two driving spindles 13' for their simultaneous rotation.

For example, it is envisioned that an image of a swimmer could be reproduced on the two adjacent blocks 2', and that animation of both one arm and one leg could be obtained by rotation of the shafts 7', the top faces of which represent corresponding image portions.

Cubic blocks 2' or elongated block 2'' can be made of one piece with a bore 28 terminated by an enlarged upper bore portion 29. Shaft 7' rotates in bore 28 and has an upper flange 30 rotatably fitting bore portion 29 and retained against step 31 by a covering 32 adhered to the top face of block 2'' and defining a sector-shaped window 33 only partially uncovering flange 30. Therefore, referring to FIG. 6, movement of the swimmer's arm and leg appear to the game user limited to that shown through window 33.

Figure 9:
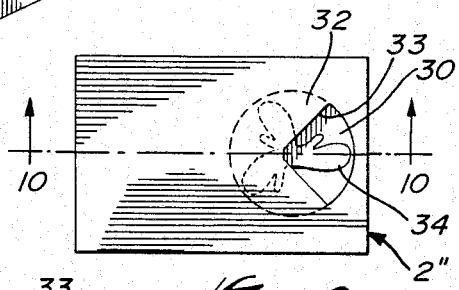
FIG. 9 is a top plan view of a block similar to that of FIG. 6 but showing another animated image.
Figure 10:
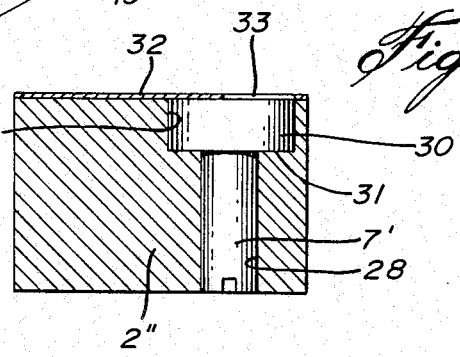
FIG. 10 is a cross-sectional view taken along line 10—10 of FIG. 9.

The same image could be repeated on shaft 7', as shown by the representation of several mitts 34 in FIG. 9. Two operating levers 20 or 20' could be provided for independently rotating the animated portions in independent manner one by one or two by two.

Spindles 13, 13' are capable of limited axial movement relative to false floor 4, so that key 12 is retracted flush with the latter when the overlying block 2, 2' has no shaft 7, 7' in register with the spindle. This allows flat contact between the block and the false floor. For this purpose, string 26 or 26' is elastic and biases the spindle 13, 13' upwardly into operative position.

As an alternate, but less preferred embodiment, spindles 13, 13' can be made of two spring-loaded telescopic sections.

A modified operating mechanism could be provided within the blocks to actuate animated portion 7 or 7' in a reciprocating linear movement.

What I claim is:

1. An animated block game, comprising:

(a) an open-top box, including side walls and at least one floor;

(b) a plurality of similar regularly-shaped blocks, designed to be removably contained by said box; at least one of said blocks including a rotatable part, embedded therewithin; all of said blocks defining a number of faces each adapted to carry parts of an image such that at least two different composite images may be formed by suitably positioning and orienting the blocks and wherein said rotatable part includes a top movable portion exposed at and occupying a restricted portion of one of said faces of said at least one block, to constitute an animatable portion of one of said images; said one face and animatable portion adapted to carry complementary parts of said one image;

(c) means for driving said rotatable part carried by said box; and (d) a disconnectable coupling means between said driving means and said rotatable part to allow removal of said one block from said box.

2. The block of claim 1, wherein said driving means includes:

(a) at least one spindle, extending under said floor rotatably carried by the latter and including an upwardly-protruding first coupling member;

(b) an operating lever pivoted under said floor intermediate its ends outwardly extending from one of said side walls; and having two inwardly-extending legs; said spindle located intermediate said legs; and (c) a string, interconnecting the free ends of said legs, and wound on said spindle, wherein said rotatable part includes a second coupling member at the bottom end thereof, said first and second coupling members being operatively and removably engageable one with the other; reciprocating lateral movement of said operating lever producing reciprocating rotation of said spindle.

3. The block game of claim 1, wherein said box includes a first, intermediate, false floor, and a second, bottom floor; said driving means extending in-between said false and bottom floors, and protruding outwardly therefrom through said false floor at one end and through one of said side walls at the other end.

4. The block game of claim 2, wherein there are at least two said spindles disposed side by side and each having a first coupling member engageable with a second coupling member of the rotatable part of an overlying block, said string wound of both spindles.

5. The block game of claim 1, wherein said rotatable part and movable portion consist of a unitary shaft rotatably mounted within a bore of said one block, and means to prevent axial movement of said shaft relative to said one block.

6. The block game of claim 5, wherein said last-named means include a flange formed on said shaft intermediate its ends and engaging a complementary bore portion of said bore.

7. The block game of claim 5, wherein said last-named means includes a covering adhering to said one face of said one block and partially overlying one end of said shaft, said one end of said shaft forming a flange engaging a complementary bore portion of said bore.

8. The block game of claim 2, wherein said first coupling member is a key, and said second connecting member is a groove; said key being insertable within said groove; said spindle being axially movable relative to said floor and said string is elastic and biases said spindle to an upper position in which said key protrudes upwardly from said floor, said spindle movable downwardly against the bias of said elastic string to a position wherein said key does not protrude from said floor.

* * * * *